US009714039B2

(12) United States Patent
Levitt et al.

(10) Patent No.: US 9,714,039 B2
(45) Date of Patent: Jul. 25, 2017

(54) KNUCKLE THROWER

(71) Applicant: Pennsy Corporation, West Chester, PA (US)

(72) Inventors: Perry Levitt, West Chester, PA (US); Aaron Stern, West Chester, PA (US); Manuel Tavares, Doylestown, PA (US); Zachary Ryan Brook, Leola, PA (US); Wayne H. Murphy, Pottstown, PA (US)

(73) Assignee: Pennsy Corporation, West Chester, PA (US)

( * ) Notice: Subject to any disclaimer, the term of this patent is extended or adjusted under 35 U.S.C. 154(b) by 199 days.

(21) Appl. No.: 14/272,687

(22) Filed: May 8, 2014

(65) Prior Publication Data

US 2015/0321680 A1 Nov. 12, 2015

(51) Int. Cl.
*B61G 3/06* (2006.01)

(52) U.S. Cl.
CPC ..... *B61G 3/06* (2013.01)

(58) Field of Classification Search
CPC ... B61G 3/04; B61G 3/06; B61G 3/24; B61G 7/00
See application file for complete search history.

(56) References Cited

U.S. PATENT DOCUMENTS 2,183,501 A 8/1936 Kinne
2,088,135 A 7/1937 Johnson et al.
2,695,714 A 11/1954 Kayler
2,948,414 A 8/1960 Metzger
3,698,570 A 10/1972 Metzger
3,853,228 A 12/1974 Metzger
4,084,705 A 4/1978 Oshinsky et al.
4,314,662 A * 2/1982 Uchida ..... B04B 5/0421 494/20
4,316,549 A * 2/1982 Klimowicz ..... B61G 3/08 213/115
4,363,414 A 12/1982 Kaim
4,438,854 A * 3/1984 Baughman ..... B61G 3/04 213/127
5,833,086 A 11/1998 Kaufhold
5,878,897 A * 3/1999 Lazzaro ..... B61G 3/06 213/139
6,206,215 B1 3/2001 Maa
6,796,448 B1 9/2004 Wilt et al.
2011/0168655 A1 7/2011 Nibouar et al.
(Continued)

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.
(Continued)

*Primary Examiner* — Mark Le
(74) *Attorney, Agent, or Firm* — John F. A. Earley III; Frank J. Bonini, Jr.; Harding, Earley, Follmer & Frailey, P.C.

(57) ABSTRACT

A knuckle thrower for a railway coupler assembly, the thrower having a knuckle actuating leg, a leg lock seat, an upper pivot structure, a lower trunnion, and stress relief feature for relieving stresses imparted on the thrower, which, according to some embodiments may include a recess provided in the perimeter wall thereof, and one or more supporting ribs.

35 Claims, 4 Drawing Sheets

(56) References Cited

U.S. PATENT DOCUMENTS

| | | | |
|---|---|---|---|
| 2012/0312768 | A1 | 12/2012 | Smerecky et al. |
| 2013/0082021 | A1 | 4/2013 | Nibouar et al. |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering and Management Systems Conference 2004.

Luís Magalhães, Jorge Seabra, "Teeth Surface Failures in Austempered Ductile Iron (ADI) Gears", Gears and Transmission Workshop, Paper No. XIII, p. 269-286, Faculdade de Engenharia da Universidade do Porto, Portugal, 5th, Jun. 2003.

International ADI and Simulation Conference; May 28-30, 1997.

Dundar, Sacit; "Application of Austempered Ductile Iron to Rail Wheel Sets"; Journal of Engineering Sciences 2003, 9 (3), p. 283-287.

Stokes, B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

SAIFoundry; "Austempered ductile iron production properties"; http://www.slideshare.net/SAIFoundry/austempered-ductile-iron-production-properties-applications#; Mar. 19, 2012.

* cited by examiner

KNUCKLE THROWER

BACKGROUND OF THE INVENTION

1. Field of the Invention

The present invention relates to railroad couplers, and more particularly to an improved knuckle thrower having improved resistance to handling load forces.

2. Brief Description of the Related Art

Railroad vehicles are generally connected together with couplers. Railroad couplers are typically constructed to railroad standards so that couplers used on railroad cars may be coupled together, even if produced by different manufacturers. Common are American Association of Railroads ("AAR") Standard E and F type railroad car couplers, and, in particular, the knuckles used in these couplers. Railcar couplers are disposed at each end of a railway car to enable joining one end of such railway car to an adjacently disposed end of another railway car. The engageable portions of each of these couplers are known in the railway art as a knuckle.

The coupling assembly for a railroad vehicle typically involves a knuckle that is pivotally mounted on the coupler, usually on spaced-apart pivot lugs at the head of the coupler and on the side opposite the guard arm side. A pivot pin extends through a pair of pivot bores respectively provided in the coupler pivot lugs and attaches the knuckle by securing the pin through the pin hole of the knuckle. The knuckle may pivot between positions while remaining installed on the coupler. A coupler typically has a cavity in the coupler head that includes a floor wall section with a pivot pin hole to receive a trunnion of a knuckle thrower. A knuckle thrower has two oppositely extending legs used to pivot the knuckle as a result of the tilting movement of a lock. The knuckle thrower is usually a cast or forged component, and is irregularly shaped. The coupler head includes a lock-receiving chamber. A lock is disposed in the chamber. The lock generally includes a lock body and a lock leg depending therefrom. The lock also has a lock set seat which rests on top of the thrower.

A lock lift is also part of the arrangement used to regulate the operation of the knuckle. A lock lift is installed at the lower portion of the coupler head cavity, and is used to regulate the position of the lock. The lock lift has a jaw or hook that is supported on a trunnion of the coupler head. The lock lift also includes a linked toggle pivotally connected to a connector or lever. The lock lift hook preferably also is connected to the lever so the hook is mounted at one pivot location on the lever and the toggle is mounted at another pivot location on the lever. The lock lift toggle opposite its lever connected end carries a trunnion thereon. The lock lift trunnion is received in a slot of the lock leg. The knuckle thrower is pivotally supported on the coupler head usually with the trunnion of the thrower seated in a bore of the coupler head. The thrower is movable with the knuckle to their locked positions. The lock moves relative to the knuckle thrower. The lock is generally movable upwardly in the lock chamber to lock set and thrown positions that correspond with the positions of the knuckle, and the lock is dropped by gravity to its locked position when the knuckle is swung to its locked position.

SUMMARY OF THE INVENTION

A knuckle thrower constructed to handle stresses imparted thereon by components of a coupling assembly when the coupling assembly is operated or engaged to regulate the position of a knuckle. The thrower has a stress relief mechanism. According to some preferred embodiments, a stress relief zone or area is configured with one or more features for improving the stress handling of the thrower when engaging another coupling assembly component or handling load forces.

According to preferred embodiments, the thrower is constructed for use in a standard coupler assembly, where a lock, lock lift, knuckle and coupler head are arranged with the thrower to regulate the knuckle operation between locked, lock set and unlocked (or thrown) positions.

According to preferred embodiments, a stress relief zone is provided between the knuckle actuating leg and the leg lock seat. According to some embodiments, the stress relief area includes a relief feature, such as an inwardly directed recess. According to some preferred embodiments, the inwardly directed recess is a radial segment formed in a wall of the thrower, which in accordance with a preferred embodiment, is provided in the front wall. According to some embodiments, the stress relief feature may include a supporting member, such as, for example, a hub or rib provided in a stress relief area. The thrower may be constructed with one or more additional ribs, such as, an adjacent rib provided along an upper or lower thrower surface. According to some preferred embodiments, the stress relief zone preferably may include one or more cavities provided in an upper or lower wall of the thrower.

According to some embodiments, the thrower may include one or more of the stress relief features, for example, a combination of one or more recesses, cavities and ribs, and preferred embodiments may include a recess in the front, a cavity in an upper or lower wall, and a hub or rib also in an upper or lower wall. According to some preferred embodiments, stress relief features are disposed in a cooperative relationship. The stress relief features may cooperate to handle or distribute forceloads received on the leg lock seat and knuckle actuating leg.

It is an object of the invention to provide a thrower for a coupling system that has improved stress handling and resistance to failure and breakage.

It is a further object of the invention to accomplish the above objects, providing an improved knuckle thrower which also meets or exceeds AAR standards for knuckle throwers.

BRIEF DESCRIPTION OF THE DRAWING FIGURES

DETAILED DESCRIPTION OF THE INVENTION

Figure 5:
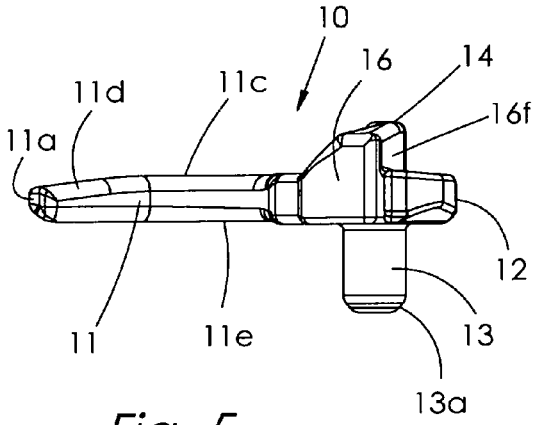
FIG. 5 is a rear elevation view of the knuckle thrower of FIG. 1.

Referring to FIGS. 1-6, and FIGS. 7-9 depicting an exemplary environment of use, a knuckle thrower 10 is shown having a knuckle actuating leg 11 and a fulcrum or leg lock seat 12. A lower trunnion 13 is shown extending from the bottom of the thrower 10, and an upper pivot structure or trunnion 14 is provided on the top of the thrower 10 (FIG. 5). The lower trunnion 13 preferably has a chamfer 13*a*. The upper pivot structure or trunnion 14 extends from a supporting structure, shown as the hub 16.

Figure 7:
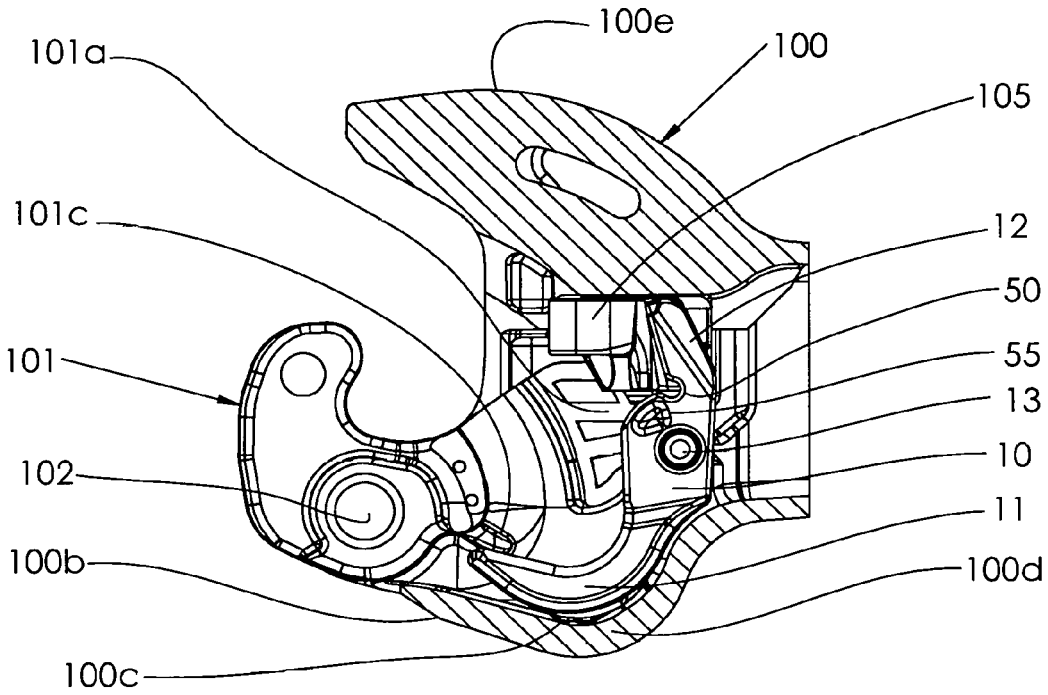
FIG. 7 is a sectional bottom view of a coupler head and coupler knuckle installed thereon illustrating an exemplary coupling assembly environment, where the thrower of FIG. 1 is shown installed thereon, the thrower and knuckle being shown in a closed or locked position.
Figure 8:
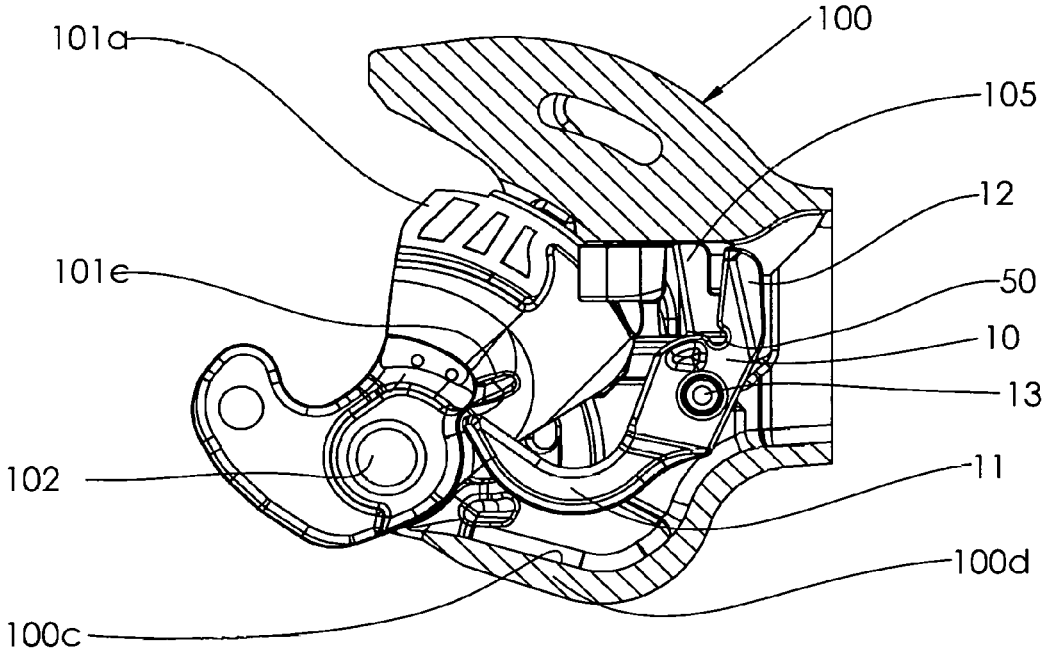
FIG. 8 is a sectional bottom view of a coupler head and coupler knuckle installed thereon illustrating the exemplary coupling assembly environment, where the thrower of FIG. 1 is shown installed thereon, as shown in FIG. 7, except with the thrower and knuckle being shown in an open or unlocked position.
Figure 9:
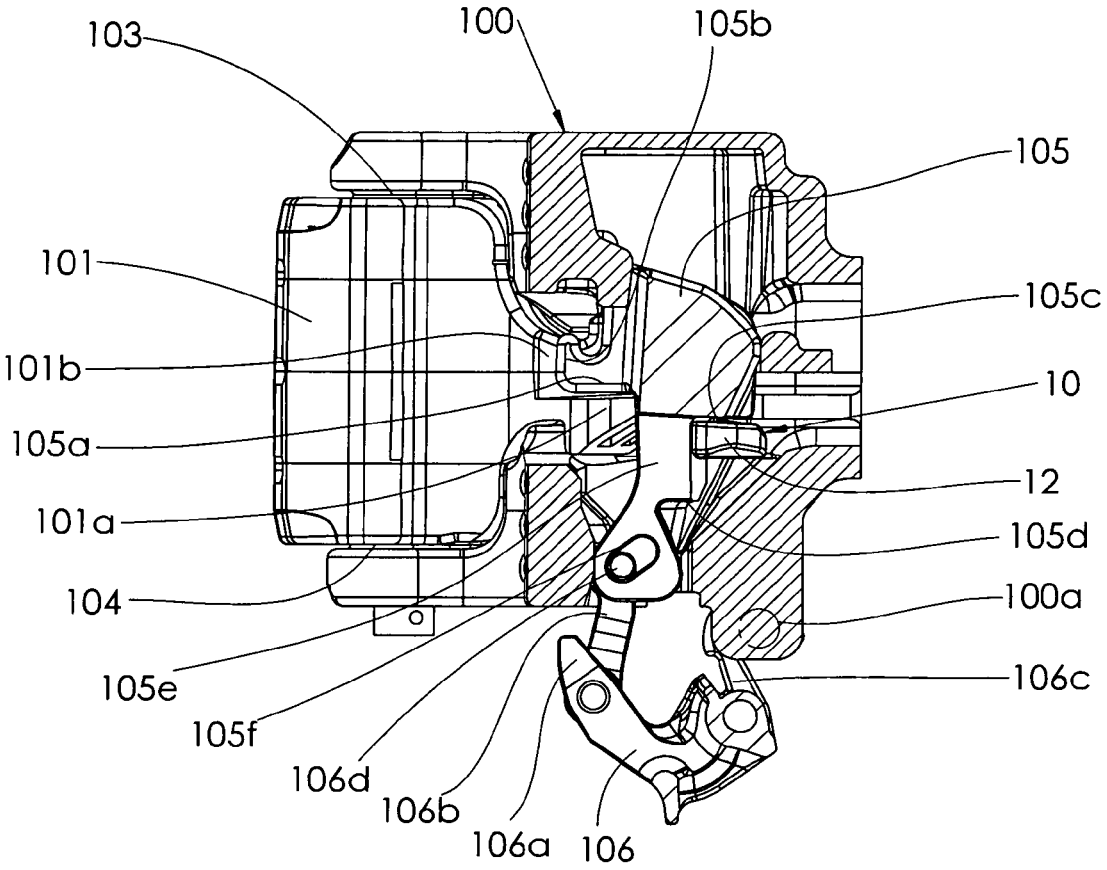
FIG. 9 is a sectional side view of the coupler head shown in FIG. 7, illustrating an exemplary coupling assembly environment, where the thrower of FIG. 1 is shown installed thereon with a knuckle, the thrower and knuckle being shown in a closed or locked position.

As illustrated in FIGS. 7-9, the thrower 10 is installed in a coupling assembly with other components. A coupler head 100 is shown with a knuckle 101 pivotally mounted on a pin 102 and being supported by upper and lower lugs 103,104 of the coupler head 100, the pin 102 forming a vertical pivot axis of the knuckle 101. The coupler head 100 has a guard arm side 100*a* and a knuckle side 100*b*. In the exemplary environment illustrated, in FIGS. 7 and 9, the movement of the knuckle 101 is shown in the closed and locked position, with the lock 105 being dropped to a lowered position. Locking results, as the lock 105 is in the path of movement of the knuckle tail portion 101*a*. The lock 105, when in the lowered position (see FIG. 9), limits movement of the knuckle 101 through its interference with the knuckle 101. The lock 105 generally has a knuckle shelf seat 105*a* (FIG. 9) which rests on a part of a tail portion 101*a* of the knuckle 101. The knuckle tail portion 101*a* is illustrated being disposed in the coupler head 100 and having vertical locking face 101*b* which is positioned to engage a locking face 105*b* of the lock 105 to prevent rotation of the knuckle 101, and thereby maintaining the knuckle 101 in the locked position (as opposed to the open position). The lock has a thrower seat 105*c*, which according to some lock configurations, may be downwardly sloped or angled. The thrower seat 105*c* is shown resting on the leg lock seat 12 of the thrower 10, locking the knuckle 101 into its closed position (FIGS. 7 and 9). The lock 105 also has a lockset seat 105*d* which is disposed longitudinally downwardly and inwardly sloped. According to a preferred embodiment, the thrower leg lock seat 12 of the knuckle thrower 10 may be configured having a slight upward slope from its trunnion pin 13 (see FIG. 5). The knuckle thrower 10 also is shown in the coupler assembly arrangement illustrated in FIGS. 7-9.

Referring to FIG. 9, in the exemplary coupling assembly environment, the leg 105*e* of the lock 105 includes the lockset seat 105*d* which engages the leg lock seat 12 of the thrower 10 to support the lock 105. When the lockset seat 105*d* engages the leg lock seat 12 of the thrower 10, the engagement is limited to the lockset seat 105*d*, with the lock 105 being cleared allowing the knuckle 101 to pivot to the open position (FIG. 8).

The knuckle thrower 10 includes a lower trunnion 13 and an upper pivot structure or trunnion 14. The lower trunnion 13 is supported within a lower thrower bore provided on the coupler head 100, while the upper trunnion 14 is supported on an upper trunnion bearing surface of the coupler 100. The trunnions 13,14 freely rotate on the coupler head 100 permitting the knuckle thrower 10 to pivot about the center lines of the trunnions 13,14. The knuckle thrower 10 is cooperatively engaged with the lock 105. As shown in FIGS. 7-9, the knuckle 101 is in a locked position, and the thrower seat 105*c* of the lock 105 is supported by the leg lock seat 12 of the knuckle thrower 10. Also shown in FIG. 9 is a conventional lock lift component 106, including a lever 106*a*, toggle 106*b* and hook or jaw 106*c* installed on a trunnion 100*a* of the coupler head 100. The lock lift component 106 includes a trunnion 106*d* carried on the end of the toggle 106*b* and shown seated for movement in the slot 105*f* of the lock leg 105*e*. Upon movement of the lock lift component 106 (in an upward direction), the lock 105 is moved from its locked position (FIGS. 7 and 9) to its lockset position (FIG. 8), where the lock 105 drops within the lock chamber of the coupler head 100, and where the lockset seat 105*d* of the of the lock 105 is seated upon the leg lock seat 12 of the knuckle thrower 10. The knuckle 101 may be thrown to its open position in a customary manner known in the industry. Upon closure, the knuckle 101 moves counterclockwise about the pin 102 on which the knuckle 101 is mounted, until the thrower pad 101*c* (FIG. 7) carried by the knuckle 101 engages the knuckle actuating leg 11 of the knuckle thrower 10. When the knuckle 100 continues counterclockwise movement, the knuckle thrower 10 is pivoted about the center line of its trunnions 13,14 in a clockwise direction. The clockwise pivotal movement of the thrower 10 results in the leg lock seat 12 to move to the locking position, as shown in FIGS. 7 and 9, whereupon the lock 105 drops to its locked position (lowered position) as a result of gravitational forces acting upon the lock 105. The knuckle thrower pad 101*c* engages the knuckle actuating leg 11 of the thrower 10, and, the thrower 10 is pivoted about the trunnions 13,14 located on the coupler head 100 in the respective mounting bore and on the bearing surface (not shown). The knuckle thrower 10 is pivoted until the knuckle actuating leg 11 engages the inner face 100*c* of the side 100*d* of the coupler head 100. According to some preferred embodiments, the coupling assembly is configured so that the engagement of the knuckle actuating leg 11 of the thrower 10 with the coupler head inner face 100*c* acts as a stop to limit further clockwise rotation the knuckle thrower 10. The leg lock seat 12 is therefore unable to move far enough to engage the lockset seat 105*d* (FIG. 9) as the lock 105 drops. As a result of preventing the further movement of the knuckle thrower 10 beyond the locking position, the lock 105 is free to drop into its locked position with the thrower seat 105*c* of the lock 105 supported by the thrower leg lock seat 12. The leg lock seat 12 is moved to engage the lock 105. As a result of the movement of the thrower 10 between its pivot positions, the engagement with the other components of the coupling assembly, (e.g., the lock, knuckle and coupler head) requires that the thrower 10 and the leg lock seat 12 handle stresses and forceloads.

Figure 1:
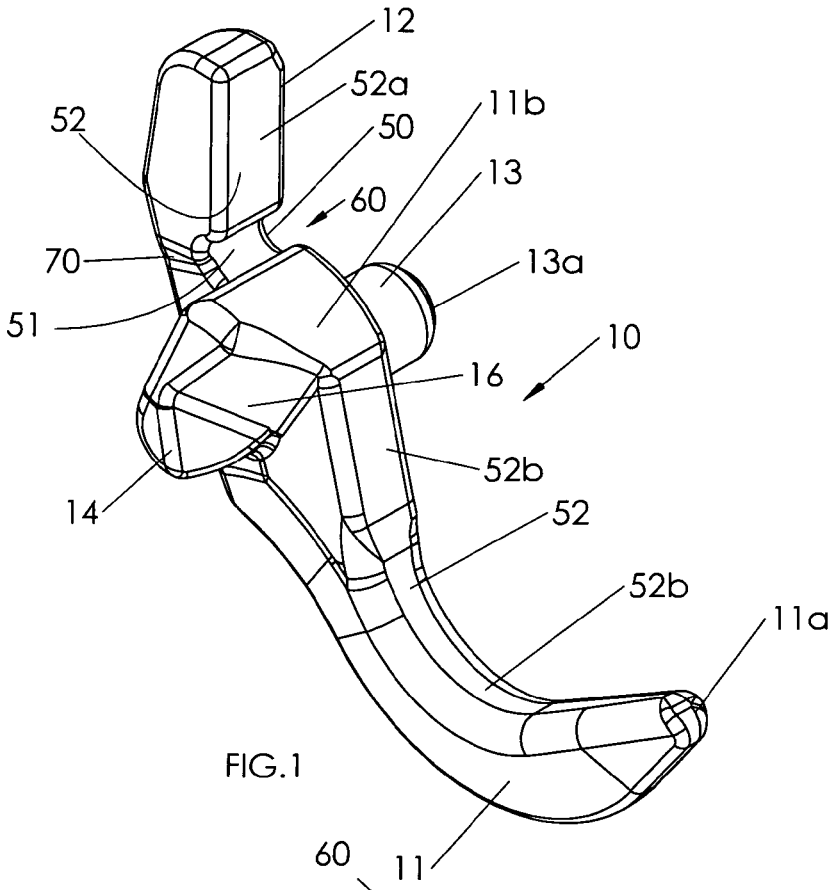
FIG. 1 is a perspective view of a knuckle thrower according to the invention, as viewed from the top thereof, looking at the front.
Figure 6:
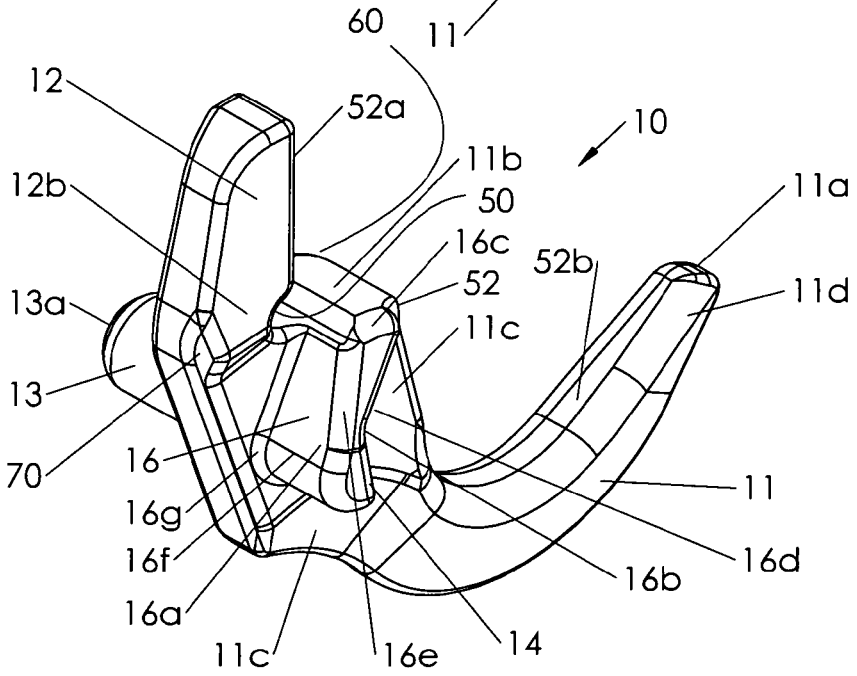
FIG. 6 is a perspective view of the knuckle thrower of FIG. 1, as viewed from the rear thereof, looking at the top thereof.
Figure 2:
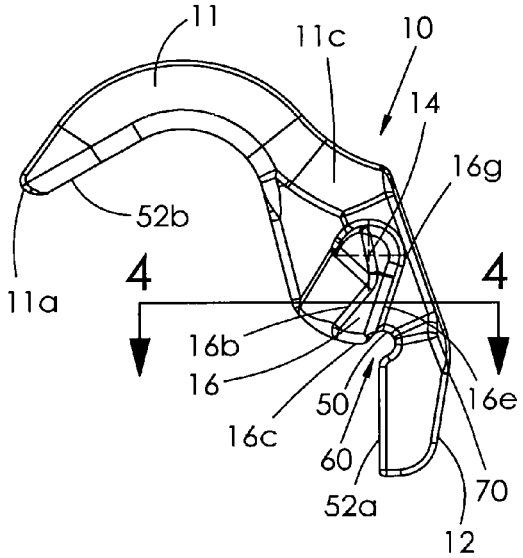
FIG. 2 is a lop plan view of the knuckle thrower of FIG. 1.
Figure 3:
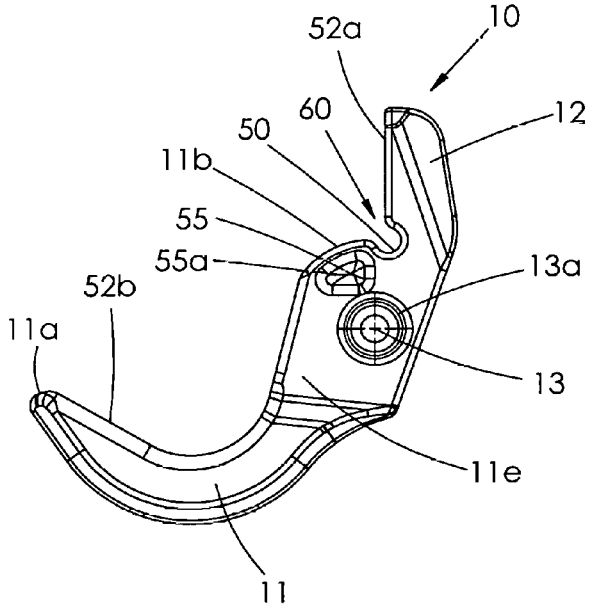
FIG. 3 is a bottom plan view of the knuckle thrower of FIG. 1.
Figure 4:
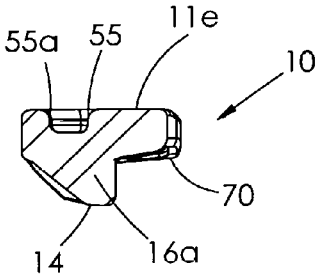
FIG. 4 is a sectional view of the thrower of FIG. 1, taken through the section line 4-4 of FIG. 2.

The thrower 10 is shown in accordance with a preferred embodiment having a stress relief feature. According to some preferred embodiments, the stress relief feature includes a stress relief area or zone 60 provided in proximity to the location where the knuckle actuating leg 11 and the leg lock seat 12 join. According to some embodiments, the stress relief area 60 includes a relief feature, such as, for example, a recess 50. Preferably, the recess 50 is provided in a perimeter wall or surface of the thrower 10, such as, for example, the front surface 52. As illustrated in the drawing figures, the knuckle actuating leg 11 joins with the leg lock seat 12 at a joining location. In accordance with a preferred embodiment, the stress relief means is provided at the joining location. According to the embodiment illustrated, the knuckle actuating leg 11 has a first end 11*a* and a shoulder 11*b* at the other end thereof where the leg lock seat 12 joins with the knuckle actuating leg 11. A relief zone 60 is provided along the front 52 of the thrower 10. One preferred embodiment illustrates the relief zone 60 provided between the shoulder 11*b* and the leg lock seat 12. The recess 50 or a portion thereof may extend into the shoulder 11*b* and/or the leg lock seat 12. According to a preferred embodiment, the relief zone 60 is provided with an inwardly disposed recess 50. The recess 50 is illustrated in a preferred configuration formed as a radial segment in the front face 52 of the thrower 10, with the radial segment forming a portion 51 of the thrower front face 52 (FIG. 1). The recess 50 preferably forms a continuous portion along the thrower front face 52, with the upper front face portion 52*a* and lower front face portion 52*b*. As illustrated in FIGS. 1-3 and 6, the thrower front face 52 preferably includes a leg lock seat front face portion 52*a* and knuckle actuating leg front face portion 52*b*. Referring to FIGS. 5 and 6, according to a preferred embodiment, the thrower knuckle actuating leg 10 preferably has an upper surface 11*c* that includes a tapered portion 11*d* that slopes downwardly toward the leg end 11*a*. The hub 16 preferably may be formed from one or more ribs 16*a* which are disposed proximate to the upper pivot surface or trunnion 14. The hub 16 is shown according to a preferred configuration provided as an upstanding rib 16*a* extending from the upper surface 11*c*. According to a preferred embodiment, the upper pivot surface or trunnion 14 is exposed to form a leading upper structure of the hub 16, or rib 16*a* forming the hub 16, for contact with an upper bearing surface of a coupler. The hub 16 is shown joining with the shoulder 11*b*, with the rib 16*a* being disposed along a pivot axis of the trunnions 13,14 and extending to the front face 52 of the thrower 10. Referring to FIGS. 2 and 6, the rib 16*a* is shown having a constriction 16*b* therein. According to a preferred embodiment, the rib 16*a* preferably may be configured with a tapered edge, and may have one or more tapered edges 16*c*,16*d*,16*e*. As illustrated according to a preferred embodiment, the rib 16*a* includes a rib wall 16*f* and a flange 16*g* at the lower portion of the wall 16*f* where the rib 16*a* joins with the thrower body or top surface 11*c*. The rib wall 16*f* may be sloped to form a sloped rib configuration, sloping from back to front, with the rib wall 16*f* being higher at the location of the pivot surface or trunnion 14 and lower at the front of the thrower 10 (see e.g., FIGS. 1, 4, 5 and 6). Referring to FIGS. 3 and 4, a lower cavity 55 is shown disposed in the lower surface 11*e* of the thrower 10, and, according to a preferred embodiment, is located at the shoulder 11*b*, and preferably, along the lower surface 11*e* between the lower trunnion 13 and the front surface 52 of the shoulder 11*b*. The lower cavity 55 preferably is formed in the body of thrower 10, and is shown having sidewalls 55*a* which are inwardly tapered. According to a preferred embodiment, the lower cavity 55 is disposed on the thrower surface 11*e* opposite that upper surface 11*c* where the hub 16 and rib 16*a* are located.

According to some preferred embodiments, the maximum wall thickness of the thrower preferably is from between about 0.25 inches and 1.25 inches. According to a preferred embodiment, the maximum thickness of a wall forming the thrower 10, including the thickness of the front face 52 (between the top surface 11*c* and lower surface 11*e*) preferably has a maximum thickness of about 1.25 inches. According to some preferred embodiments, where the maximum thickness is about 1.25 inches, the cavity 55 preferably is located below the hub 16 or a portion thereof to provide an area of reduced thickness in the body 11*c* so that the hub wall and reduced body thickness preferably are within the maximum thickness of 1.25 inches. Each of the upper pivot structure or trunnion 14 and lower trunnion 13 is shown raised relative to the respective thrower top surface and thrower bottom surface. For example, the hub 16 is raised from the upper surface and may support the upper trunnion or pivot structure. In the embodiment illustrated, the cavity 55 is provided in the surface opposite of the hub 16. The raised hub 16 and cavity 55 preferably define a wall segment of the thrower wall having a wall thickness. According to preferred embodiments, the thrower, including the wall segment may be constructed to have the wall thicknesses, as described herein. According to one preferred embodiment, the maximum wall thickness of the thrower walls may be less than about 1.25 inches. According to preferred embodiments, the thrower wall thickness may extend between the top and bottom surfaces, inclusive of structure raised therefrom, such as, for example, the upper trunnion 14 and lower trunnion 13. In the embodiment illustrated, the cavity 55 and raised portion, such as, for example, the huh 16 and upper trunnion or pivot structure 14, are disposed in a cooperative relationship to maintain a desired wall thickness for the thrower 10. According to a preferred embodiment, the wall thickness may be constructed having a maximum thickness which is defined based on an equivalent spherical diameter. According to a preferred embodiment, the thickness may be defined as the diameter of a sphere that would occupy the thrower 10. For example, where the maximum thickness is 1.25 inches, then a sphere having a diameter of 1.25 inches would be the maximum that would fit within the volume taken up by the thrower 10 (including the thrower surfaces). According to a preferred embodiment, where the maximum thickness of the thrower 10 is 1.25 inches, then a sphere having a diameter larger than 1.25 inches would be outside of the volume taken up by the thrower 10. Conversely, spheres having diameters less than 1.25 inches would fit within the volume of the thrower 10, and, according to preferred embodiments, the thrower 10 may have a minimum wall thickness. For example, the minimum wall thickness may be specified to be no less than about 0.25 inches, where a sphere having a diameter of at least 0.25 inches is the minimum. For example, according to a preferred embodiment, the thrower 10 is constructed with a wall thickness that would permit a sphere of 0.25 inches to fit within the volume of the thrower 10. According to some embodiments, the maximum equivalent spherical diameter may be up to five times the minimum equivalent spherical diameter. According to some preferred embodiments, the range for the sphere diameter for spheres that fit within the thrower volume is from about 0.25 to about 1.25 inches.

According to some embodiments, the thrower 10 may be constructed from Grade E steel or ductile iron, and according to some preferred embodiments, the thrower 10 may be constructed from an austempered metal, such as, for example, austempered steel, austempered alloy steel, as well as other austempered metals, and austempered metal alloys. According to a preferred embodiment, the thrower 10 is constructed from austempered ductile iron. The ductile iron from which the thrower 10 is formed, may include austempered ductile iron that comprises ductile iron alloyed with one or more metals selected from the group consisting of nickel, molybdenum, manganese, copper and mixtures thereof. According to preferred embodiments, the metal, such as, for example, according to a preferred embodiment, ductile iron used to produce the thrower 10, may be treated by a treatment process, and preferably a process to strengthen the material, and to provide a suitable microstructure in the formed thrower 10. According to preferred embodiments, the treatment process preferably involves an austenitizing process, by which the formed thrower 10 is an austempered material, and more preferably, austempered ductile iron (ADI). For example, the forming of the thrower 10 may involve applying a suitable austenitizing process to a formed ductile iron thrower, (e.g., a casting or other method of forming the thrower 10). One preferred method involves heating the thrower casting (or other produced thrower, if not produced from a casting) in a heat extraction composition, such as, for example, a molten salt bath, to austenitizing temperature and holding the bath at an austenitizing temperature so as to dissolve carbon in austenite, followed by quenching (which preferably is rapidly done) to avoid pearlite formation, and holding the thrower at an austempering temperature in the molten salt bath. The isothermal transformation to ausferrite preferably takes place to provide an austempered ductile iron thrower 10. According to alternate embodiments, austempered ductile iron (ADI) may include ductile iron alloyed with one or more metals, such as, for example, nickel, molybdenum, manganese, copper and mixtures thereof.

Referring to FIGS. 1, 2, 4 and 6, according to a preferred embodiment, an adjacent supporting structure may be provided and is shown according to a preferred embodiment formed as an adjacent rib 70. The adjacent rib 70 is provided on the lower surface 11*e* and is shown spanning from the rear of the thrower 10 to the front, and to the recess 50. Referring to FIG. 6, the adjacent rib 70 may be formed in part by a sloped wall portion 12*b* of the leg lock seat 12.

These and other advantages may be realized with the present invention. While the invention has been described with reference to specific embodiments, the description is illustrative and is not to be construed as limiting the scope of the invention. For example, although the standard type-E coupler or portion thereof has been shown in the drawings for illustrative purposes, the inventive knuckle thrower may be used in conjunction with other couplers, such as, for example, type-F couplers. In addition, the thrower preferably is constructed from a suitable material, which, for example, may be Grade E steel, and which, according to preferred embodiments may be austempered metal, and more preferably, austempered ductile iron (ADI). The thrower may be formed by any process, including molding, casting, forging or other process. The knuckle thrower also may be constructed having radiused edges along its perimeter. The dimensions and thicknesses of the knuckle thrower preferably are such that the knuckle throwers according to the invention, such as the knuckle thrower 10 shown and described herein, may be used in standard coupling assemblies with other standard components, such as, for example, knuckles, locks and lock lifts. The improved thrower 10 preferably is interchangeable with prior throwers, and knuckle throwers according to the invention may meet or exceed AAR standards for knuckle throwers. Various modifications and changes may occur to those skilled in the art without departing from the spirit and scope of the invention described herein and as defined by the appended claims. It is intended that the foregoing detailed description be regarded as illustrative rather than limiting, and that it be understood that it is the following claims, including all equivalents, that are intended to define the spirit and scope of this invention.

What is claimed is:

1. A knuckle thrower for a railway coupler assembly, comprising:

a) a knuckle actuating leg;

b) a leg lock seat;

c) an upper trunnion;

d) a lower trunnion; and e) stress relief means for relieving stresses imparted on the thrower;

f) wherein said thrower has a front and a rear;

g) wherein said upper trunnion includes a trunnion rib that spans toward the front of the thrower;

h) wherein the stress relief means comprises a recess bounded by outer end edges on the thrower front;

i) wherein said recess is disposed inwardly from the thrower front, and wherein at least a portion of said recess is inwardly disposed relative to said trunnion rib.

2. The knuckle thrower of claim 1, wherein said knuckle actuating leg joins with said leg lock seat at a joining location, and wherein said stress relief means comprises a relief zone disposed at said joining location.

3. The knuckle thrower of claim 2, wherein said knuckle actuating leg has a first end and a shoulder at the other end thereof, wherein said leg lock seat joins with said knuckle actuating leg at said shoulder, and wherein said relief zone extends between said shoulder and said leg lock seat.

4. The knuckle thrower of claim 1, wherein said stress relief means further comprises an adjacent rib.

5. The knuckle thrower of claim 4, wherein said adjacent rib is disposed proximate said upper trunnion.

6. The knuckle thrower of claim 1, wherein said thrower is constructed from an austempered metal.

7. The knuckle thrower of claim 6, wherein said austempered metal is austempered ductile iron.

8. The knuckle thrower of claim 6, wherein said austempered metal is selected from the group consisting of austempered ductile iron, austempered steel and austempered alloy steel.

9. The method of claim 7, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said thrower.

10. The knuckle thrower of claim 7, wherein thickness of the thrower is defined by diameters of spheres fitting within a volume that the thrower occupies, wherein the diameter of any sphere fitting within the volume that the thrower occupies has a minimum diameter of about 0.25 inches and a maximum diameter of about 1.25 inches.

11. The knuckle thrower of claim 1, the thrower having a top and a bottom, including at least one raised portion raised relative to one of said top or said bottom, said raised portion supporting at least one of said upper trunnion and said lower trunnion, and said thrower having a cavity provided in said top or said bottom opposite of said at least one raised portion;

wherein said lower trunnion extends downwardly from said bottom, said bottom including a cavity disposed therein; and wherein said lower trunnion is disposed in a location separate from said cavity.

12. The knuckle thrower of claim 11, wherein said raised portion and said cavity define a segment of wall having a wall thickness.

13. The knuckle thrower of claim 12, wherein a wall thickness defined between said top and said bottom and between said upper trunnion and said lower trunnion, wherein a maximum wall thickness is defined between said top and said bottom and between said upper trunnion and said lower trunnion, and wherein said maximum wall thickness is about 1.25 inches.

14. The knuckle thrower of claim 12, wherein said raised portion supports said upper trunnion and wherein said cavity is provided in said bottom.

15. The knuckle thrower of claim 1, wherein said thrower includes an upper surface and a lower surface, the lower trunnion extending downwardly from said lower surface, said lower surface including a cavity disposed therein; and wherein said lower trunnion is disposed in a location separate from said cavity.

16. The knuckle thrower of claim 1, wherein said thrower has a lower surface and an upper surface;

wherein the recess is in the front of the thrower, and wherein an adjacent supporting structure is provided on at least one of the upper surface or lower surface.

17. The knuckle thrower of claim 16, wherein said adjacent supporting structure comprises a rib.

18. The knuckle thrower of claim 17, wherein said rib spans from the rear of the thrower to the front of the thrower, and to the recess provided in the thrower front.

19. The knuckle thrower of claim 17, wherein said rib comprises a sloped wall portion.

20. The knuckle thrower of claim 1, wherein said thrower front has a front face, and wherein the thrower has an upper surface, wherein said upper trunnion includes a pivot surface, and wherein said stress relief means further comprises an upwardly extending trunnion rib disposed to support said pivot surface, and wherein said recess comprises a radial recess disposed in said front face, said thrower including a shoulder connecting said leg lock seat and said actuating leg, and an adjacent supporting structure comprising an adjacent rib, said adjacent rib spanning across said upper surface to the location of said recess, and wherein said trunnion rib spans in the direction toward the thrower front face and extends in the direction of said front face beyond said recess.

21. A knuckle thrower for a railway coupler assembly, comprising:

a) a knuckle actuating leg;

b) a leg lock seat;

c) an upper trunnion;

d) a lower trunnion; and e) stress relief means for relieving stresses imparted on the thrower;

f) wherein said thrower has a front face and an upper surface, g) wherein said upper trunnion includes a pivot surface, and h) wherein said stress relief means comprises an upwardly extending trunnion rib disposed to support said pivot surface and a radial recess bounded by outer end edges disposed in said front face, i) said thrower including a shoulder connecting said leg lock seat and said actuating leg, and an adjacent supporting structure comprising an adjacent rib, said adjacent rib spanning across said upper surface to the location of said recess, j) wherein said trunnion rib spans in the direction toward the thrower front face and extends in the direction of said front face beyond said recess.

22. In a railroad coupler having a coupler head having a guard arm side and a knuckle side including a knuckle swingable about a vertical axis, a tail portion extending from said knuckle, a coupler lock positioned within a vertical lock chamber formed within said coupler head between said guard arm side and said knuckle side, said coupler lock being movable within said chamber from a locking position wherein said lock is in the path of movement of said tail portion of said knuckle to maintain said knuckle in a closed position, a knuckle thrower having a leg lock seat, said lock having a lock set seat in engagement with said knuckle thrower leg lock seat when moved to an unlocked position whereby said knuckle is free to swing toward an open position, the improvement comprising:

said thrower having an upper trunnion, a lower trunnion, a knuckle actuating leg having an end thereof, and said knuckle leg lock seat having an end thereof, and a recess provided at a location on the thrower between said knuckle actuating leg end and said knuckle leg lock seat end;

wherein said leg lock seat end includes a first end portion located away from the upper trunnion and lower trunnion, and a second end portion which is located relatively closer to the upper trunnion and lower trunnion; wherein said recess is inwardly directed and begins its inward direction at the leg lock seat second end;

wherein said thrower has a front side and a rear side, wherein said recess is bounded by outer end edges disposed on said front side of the thrower;

wherein said thrower has a mid section, wherein the mid section includes a shoulder, wherein the knuckle actuating leg is connected to the mid section, wherein said recess separates said locking leg from said mid section, and wherein said recess is provided between said mid section and said leg lock seat.

23. The coupler of claim 22, including an adjacent rib.

24. The coupler of claim 23, wherein said adjacent rib is disposed proximate said upper trunnion.

25. The coupler of claim 22, wherein said thrower recess comprises a radial recess.

26. The coupler of claim 25, wherein said thrower has an upper side thereof and a lower side thereof, wherein said upper trunnion is located on the upper side, and a wherein the lower trunnion is located on the lower side, said thrower including a rib disposed on said thrower upper side.

27. The coupler of claim 26, wherein said thrower includes an upper surface on the upper side and a lower surface on the lower side, the lower trunnion extending downwardly from the lower surface, the lower surface including a cavity disposed therein.

28. The coupler of claim 27, wherein the cavity is formed in said lower surface at a location adjacent to the location of said lower trunnion.

29. The coupler of claim 25, wherein said thrower includes an upper surface and a lower surface, the lower trunnion extending downwardly from said lower surface, said lower surface including a cavity disposed therein.

30. The coupler of claim 29, wherein the lower trunnion is disposed at a location separate from said cavity.

31. The coupler of claim 22, wherein said thrower has an upper side thereof and a lower side thereof, wherein said upper trunnion is located on the upper side, and wherein the lower trunnion is located on the lower side, said thrower including a rib disposed on said thrower upper side.

32. The coupler of claim 22, wherein said thrower includes an upper surface and a lower surface, the lower trunnion extending downwardly from said lower surface, said lower surface including a cavity disposed therein.

33. A knuckle thrower for a railway coupler assembly, comprising:

a) a knuckle actuating leg;

b) a leg lock seat;

c) an upper pivot structure;

d) a lower trunnion;

e) said knuckle actuating leg and said leg lock seat being connected and each having an end thereof;

f) wherein said knuckle actuating leg and said leg lock seat are inwardly disposed relative to each other;

g) wherein said thrower has a perimeter defining it, and wherein a recess is disposed along said perimeters;

h) wherein at least one rib is provided proximate to the location of said recess; and i) wherein said recess is bounded by outer end edges disposed on a thrower front and said lower trunnion is disposed inwardly from the thrower front.

34. The knuckle thrower of claim 33, wherein a first rib is provided to support said upper pivot structure, and wherein a second rib is provided spanning from the recess in a direction adjacent thereto, wherein said thrower has an upper face and wherein said second rib is disposed on said upper face.

35. The coupler of claim 21, wherein said lower trunnion extends downwardly from a lower surface, and wherein a cavity is formed in said lower surface at a location adjacent to the location of said lower trunnion.

* * * * *